US005490613A

United States Patent [19]

Taylor et al.

[11] Patent Number: 5,490,613

[45] Date of Patent: Feb. 13, 1996

[54] VISCOUS FLUID DISPENSER

[75] Inventors: R. Gregory Taylor, Pleasanton; Larry F. Morice, San Ramon, both of Calif.

[73] Assignee: The Clorox Company, Oakland, Calif.

[21] Appl. No.: 271,815

[22] Filed: Jul. 7, 1994

[51] Int. Cl.[6] ..... B65D 35/28

[52] U.S. Cl. ..... 222/102; 222/105

[58] Field of Search ..... 222/101, 102, 222/103, 105

[56] References Cited

U.S. PATENT DOCUMENTS

| | | | |
|---|---|---|---|
| 1,510,818 | 10/1924 | Barron . | |
| 1,793,787 | 2/1931 | Ertola . | |
| 2,543,667 | 2/1951 | Palmer | 222/101 |
| 2,545,342 | 3/1951 | Choquette | 222/101 |
| 2,690,858 | 10/1954 | Peralta et al. | 222/93 |
| 2,734,662 | 2/1956 | Shippen | 222/102 |
| 2,901,147 | 8/1959 | Bond, Jr. | 222/102 |
| 3,151,616 | 10/1964 | Selfon | 128/214 |
| 3,197,072 | 7/1965 | Dick | 222/102 |
| 3,946,904 | 3/1976 | Mulakala | 222/102 |
| 4,226,336 | 10/1980 | Young | 222/102 |
| 4,418,840 | 12/1983 | Gardner, Sr. | 222/96 |
| 4,551,139 | 11/1985 | Plaas et al. | 604/290 |
| 4,639,251 | 1/1987 | Kirkland | 604/260 |
| 4,765,512 | 8/1988 | Bull, Jr. | 222/100 |
| 4,946,072 | 8/1990 | Albert et al. | 222/105 |
| 5,067,635 | 11/1991 | Thompson | 222/103 |
| 5,118,011 | 6/1992 | Kopp | 222/102 |

FOREIGN PATENT DOCUMENTS 1089091 11/1967 United Kingdom .

*Primary Examiner*—Kevin P. Shaver

*Attorney, Agent, or Firm*—Joel J. Hayashida; Michael J. Mazza; Harry A. Pacini

[57] ABSTRACT

A dispenser for viscous fluids includes a housing having a hanger assembly for suspending a collapsible bag with a dispenser outlet extending from an opening at the bottom of the housing, and a pair of rollers riding in parallel pairs of slots vertically extending in opposite sides of the housing. The rollers form a nip for receiving the collapsible bag whereby the rollers jointly doctor or extrude fluid in the bag toward the dispenser outlet at a substantially constant delivery rate in response to operation of the dispenser.

8 Claims, 7 Drawing Sheets

VISCOUS FLUID DISPENSER

FIELD OF THE INVENTION

The present invention relates to dispensers of a type adapted for dispensing viscous fluids and more particularly to such dispensers where the fluid is contained within and dispensed from a flexible or collapsible bag forming a portion of the dispenser.

BACKGROUND OF THE INVENTION

Dispensers of the type contemplated by the present invention may be employed for a wide variety of viscous fluids including foods or condiments such as salad dressings and the like, cosmetics or personal care products such as hand creams, moisturizers, shampoos and the like, cleaning products and even fluids such as lubricating oils or greases.

It is generally contemplated that the dispenser can be employed in a variety of settings such as food service stores or institutions, other commercial settings and even for personal use in homes and the like.

Regardless of the setting, it is further contemplated that the fluid be initially stored in a flexible or collapsible bag which can then be arranged in a dispenser operable for dispensing the fluid from the bag in a simple and effective manner to assure delivery of a satisfactory amount of the fluid at a proper rate of delivery.

It is further desirable that the dispenser be capable of dispensing the material only in response to operation of a dispenser device by a user. Otherwise, it is important that the dispenser be capable of storing the fluid, possibly for extended periods of time. In some applications, it may be necessary or desirable to store the fluid in a controlled environment, for example in a refrigerated or cooled area, possibly overnight or between normal intervals of use requiring operation of the dispenser. Under such circumstances, it is contemplated that the flexible or collapsible bag be removable from the container for separate storage and then returned to the container for further use.

In still other applications, it may be important that the fluid be prevented from contacting the air or the environment at least until the fluid is properly dispensed.

Numerous devices have been provided in the prior art for meeting certain of these conditions. Generally, such devices have contemplated arrangement of a container so that the fluid may flow from the container under the influence of gravity. Other dispensers have typically provided mechanical means such as springs or ratchets to assist in extruding the fluid from a flexible or collapsible bag.

These dispensers have been generally satisfactory for their intended use. However, there has been found to remain a need for further improvements in such containers to facilitate the dispensing of fluids in a simple and effective manner.

SUMMARY OF THE INVENTION

It is accordingly an object of the present invention to provide an improved dispenser for viscous fluids suitable for use in applications of the type outlined above.

More specifically, it is an object of the invention to provide a viscous fluid dispenser of a type including a housing with hanger means for supporting a collapsible bag in the housing, the collapsible bag having an outlet and dispenser arranged in an opening of the housing, and guide means in the housing for maintaining a pair of rollers in opposed relation with the collapsible bag therebetween, the rollers being of sufficient mass for collapsing the bag and positively expelling or doctoring fluid from the bag in response to operation of the dispenser means.

It is more specifically an object of the invention to provide such a dispenser wherein the collapsible bag is completely closed except for its outlet so that the fluid remains unexposed to the atmosphere until it exits from the bag outlet.

Preferably, the guide means comprise two parallel pairs of linear slots arranged vertically in opposite sides of the housing with the rollers having axles extending through the slots. More preferably, yoke means are arranged on each pair of exposed axles for the rollers in order to establish a nip between the rollers to assure doctoring of substantially all fluid from the bag.

The housing is preferably split between the parallel slots into two portions which are hinged together at their upper extremities, the housing portions including roller retaining slot extensions which are turned relative to the linear slots sufficiently for retaining the rollers, for example, when the hinged housing is opened to install or replace a bag with viscous fluid.

It is a further object of the invention to provide a dispenser of the type described above as separate apparatus for use with a replaceable bag. It is also a further object of the invention to provide a collapsible bag as described above for use with a dispenser also of the type described above.

It is a more general object of the invention to provide a dispenser having a housing with hanger means for suspending a collapsible bag with an outlet and dispenser means as described above and further comprising at least one roller means having a mass sufficient for collapsing the bag under the influence of gravity in order to positively expel the fluid from the bag in response to operation of the dispenser means and guide means formed on the housing for allowing the roller means to send under the influence of gravity from an initial position adjacent the hanger means only when the fluid is expelled from the bag.

More particularly, the housing is also provided with means forming a reaction surface providing a nip with the one roller means, the bag being arranged in the nip to have fluid doctored therefrom. More preferably, the means forming the reaction surface in the housing is a similar roller means.

Additional objects and advantages of the invention will be apparent from the following description having reference to the accompanying drawings.

DESCRIPTION OF THE PREFERRED EMBODIMENTS

Figure 1:
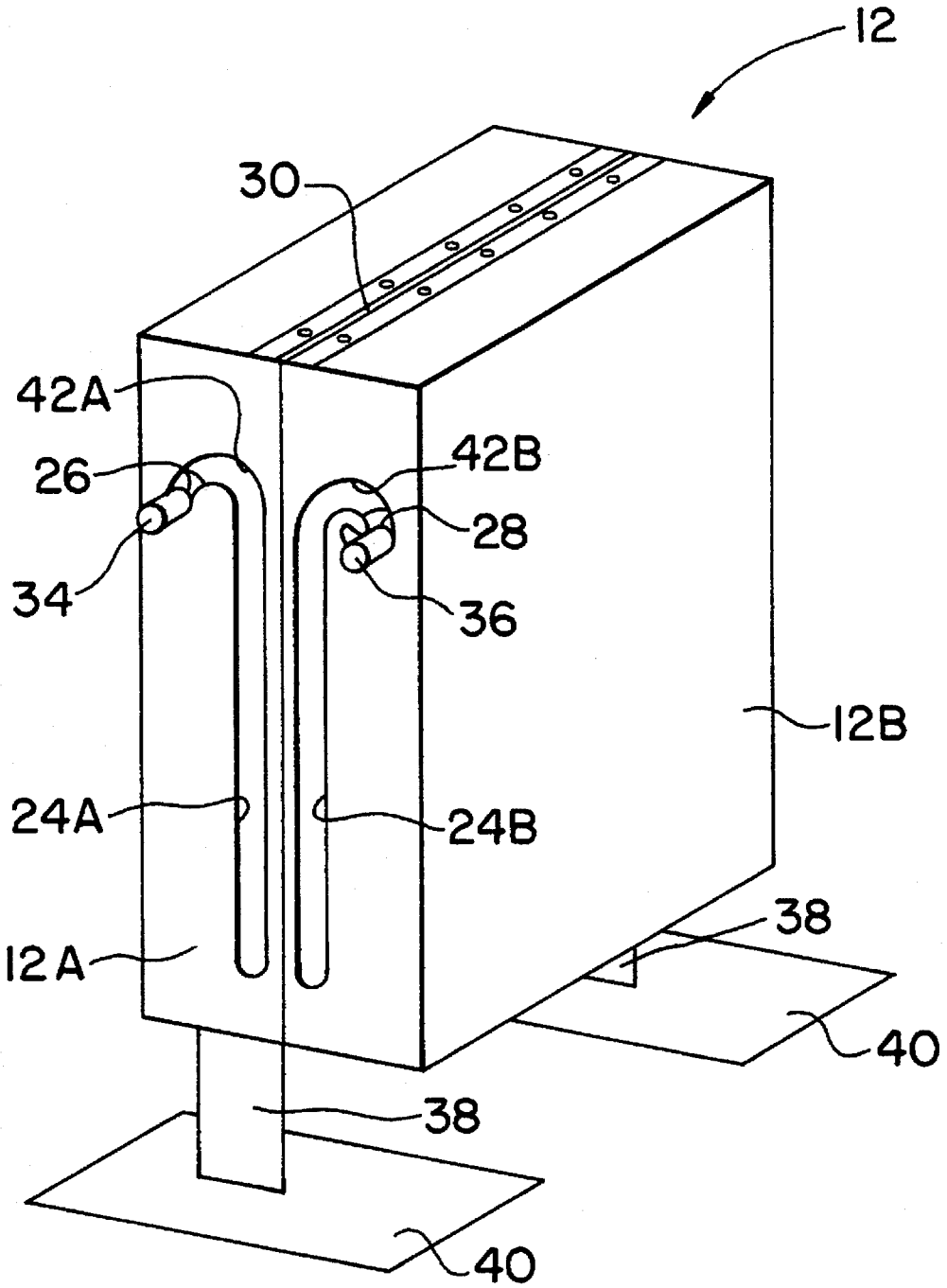
FIG. 1 is a pictorial representation of the viscous fluid dispenser of the present invention prior to installation of a collapsible bag containing viscous fluid.

Referring now to the drawings in combination, the present invention is directed toward a dispenser assembly 10 (see FIG. 5 and 6) adapted for use in a wide variety of applications for dispensing generally viscous fluids. For purposes of the present invention, such viscous fluids are generally contemplated as including any fluids which are sufficiently viscous to prevent evacuation of a collapsible bag containing the fluid under the influence of gravity flow of the fluid itself. At the same time, the invention contemplates use of the dispenser with fluids having a maximum viscosity where the fluid is readily capable of extrusion from such a collapsible bag. Preferably, the invention contemplates use of the dispenser assembly with fluids having a viscosity generally in the range of from about 1 to about 15,000 centipoise (cps), as measured, for example, on a Brookfield Rotoviscometer using a No. 5/6 spindle at 50 rpm.

The invention more preferably contemplates use of the dispenser assembly 10 with foods or condiments, the dispenser assembly 10 being more preferably adapted for dispensing salad dressing. However, it is to be understood that the dispenser assembly of the present invention is readily capable of use with a wide variety of viscous fluids including other foods or condiments as well as cosmetics or personal care products such as hand creams, moisturizers and shampoos, various cleaning products and even thick lubricating oils or greases.

The dispenser assembly 10 of the present invention is also adapted for use with fluids generally requiring protection from oxidation or exposure to the environment. At the same time, the dispenser assembly can also be used with fluids requiring at least intermittent cooling or refrigeration. In this regard, it would of course be possible to provide refrigeration within the dispenser housing; however, such refrigeration is not described or illustrated herein because it is not contemplated as a specific element of the invention. At the same time, the dispenser assembly of the invention may also be adapted for intermittent cooling or refrigeration of products such as foods or condiments including salad dressing. For example, where the dispenser is used in a commercial or institutional setting such as a fast food operation, it may be desired to make the dispenser available during certain hours and to otherwise maintain the product in refrigeration. For that purpose, the dispenser assembly 10 of the present invention is equipped for removal of the collapsible bag in an unused condition or partially used condition so that the collapsible bag may be refrigerated and returned for use in the dispenser assembly at a later time.

Figure 5:
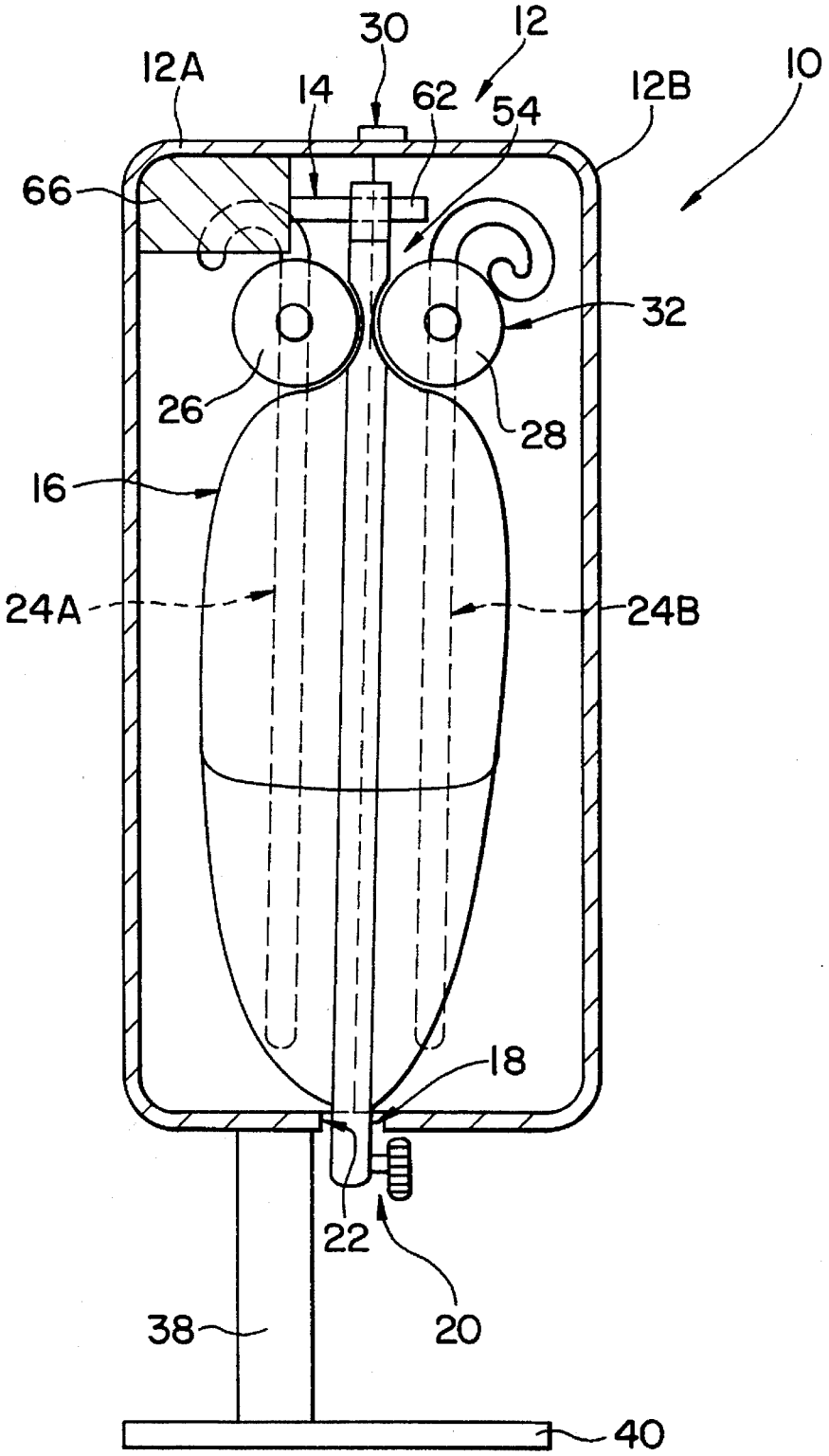
FIG. 5 is a side view taken along section line V—V of FIG. 2 in order to illustrate the collapsible bag suspended in place within the housing and the rollers in an initial position engaging the bag under the influence of gravity.
Figure 6:
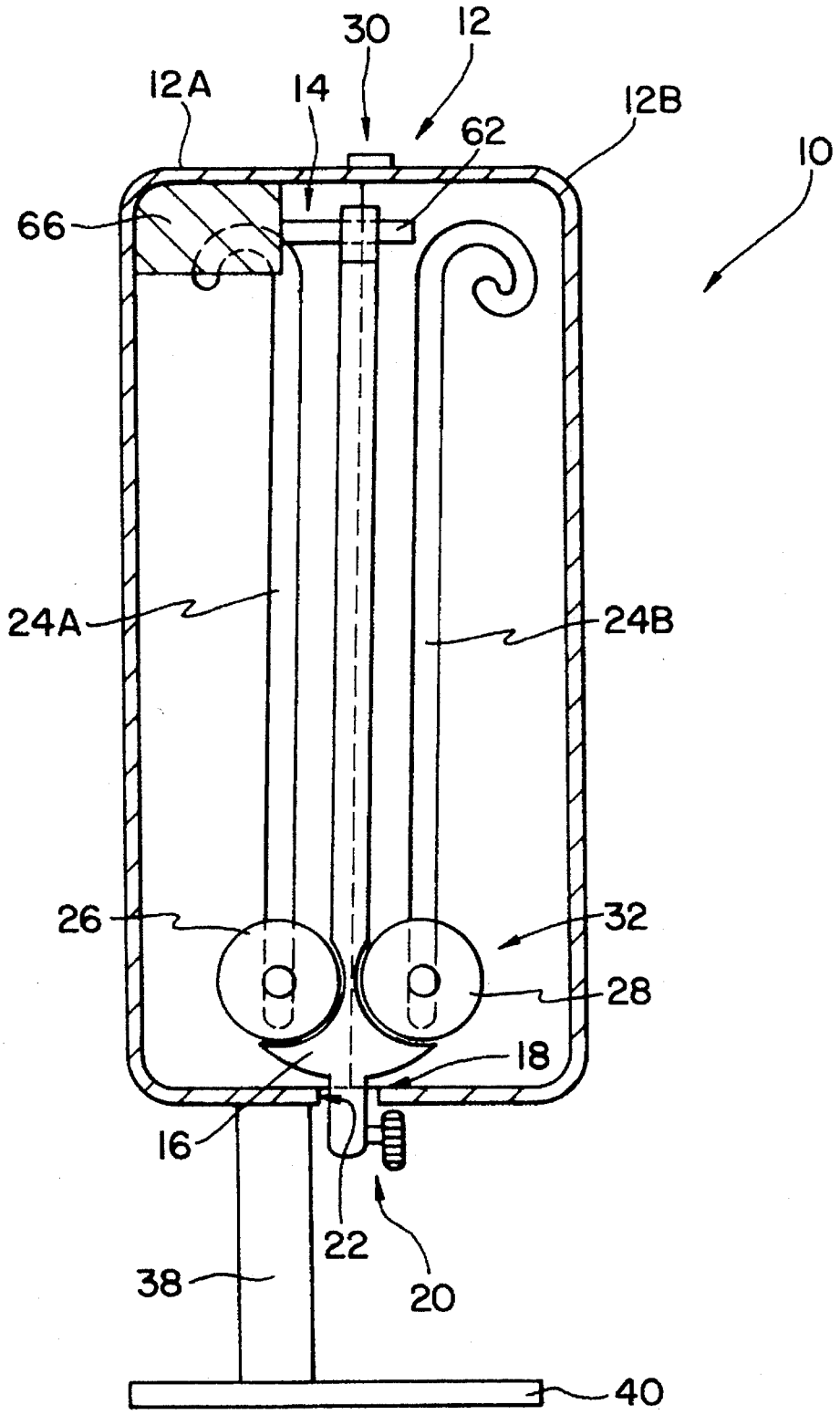
FIG. 6 is a sectioned view similar to FIG. 5 while illustrating the bag in an empty condition after the rollers have doctored substantially all fluid from the bag.

Referring particularly to FIG. 5, the dispenser assembly of the present invention includes a housing 12 having hanger means 14 for suspending a collapsible bag 16 with an outlet 18 and dispenser means 20 for the bag extending through an opening 22 in a lower portion of the housing 12. Multiple guide slots 24 are formed in the housing for maintaining opposed rollers 26 and 28 in engagement with the collapsible bag and free for movement under the influence of gravity for extruding or doctoring fluid from the bag as described in greater detail below.

The housing 12 is preferably divided between the guide slots 24 into two portions 12A and 12B which are hinged together at 30 to permit opening of the housing 12 for installing or replacing the collapsible bag 16.

The various elements of the dispenser assembly 10 are described in greater detail below. However, it is to be understood that a number of variations are possible within the scope of the present invention. For example, it is particularly contemplated that the housing 12 be capable of use with only a single gravity-operated roller such as that indicated at 26. With such a single roller, a reaction surface would be provided for forming a nip as described in greater detail below. For purposes of illustration, such a reaction surface is illustrated in FIG. 5 by the surface 32 of the other roller 28. If the dispenser assembly 10 were to be employed with a single roller, it is preferably contemplated that the housing would be tilted or inclined to provide a generally inclined fixed reaction surface (not shown).

The elements of the dispenser assembly 10 are described in greater detail below having reference to the various drawings.

Referring now to FIG. 1, the housing 12 is illustrated without the collapsible bag 16. The rollers are represented by axles 34 and 36 extending from the respective rollers 26 and 28 through parallel guide slots 24A and 24B on one side of the housing 12. Similar guide slots 24A and 24B are also formed on the opposite side of the housing as partially illustrated in FIG. 3 and as illustrated by hidden lines in FIG. 5.

Referring again to FIG. 1, the housing portion 12A is considered to be fixed with the other housing portion 12B being generally movable about the hinge 30. Accordingly, the fixed housing portion 12A is provided with legs 38 which are respectively secured to base plates 40 so that the housing 12 is generally free-standing.

The guide slots 24A and **24*b* on both sides of the two housing portions 12A and 12B are provided with roller retaining slot extensions 42A and 42B. The roller retaining extensions are designed for securing the rollers 26 and 28 at the upper end of the housing 12 when the housing is opening, for example, to install or replace the collapsible bag 16. More specifically, the roller retaining slot extension 42A on each side of the housing portion 12A is turned outwardly approximately 180° relative to the vertically extending guide slot 24A. Thus, it is possible to raise the roller 26 to the top of the guide slots 24A and then outwardly along the roller retaining slot extensions 42A so that the roller 26 rests with its axles 34 in the slot extensions 42A**.

Figure 3:
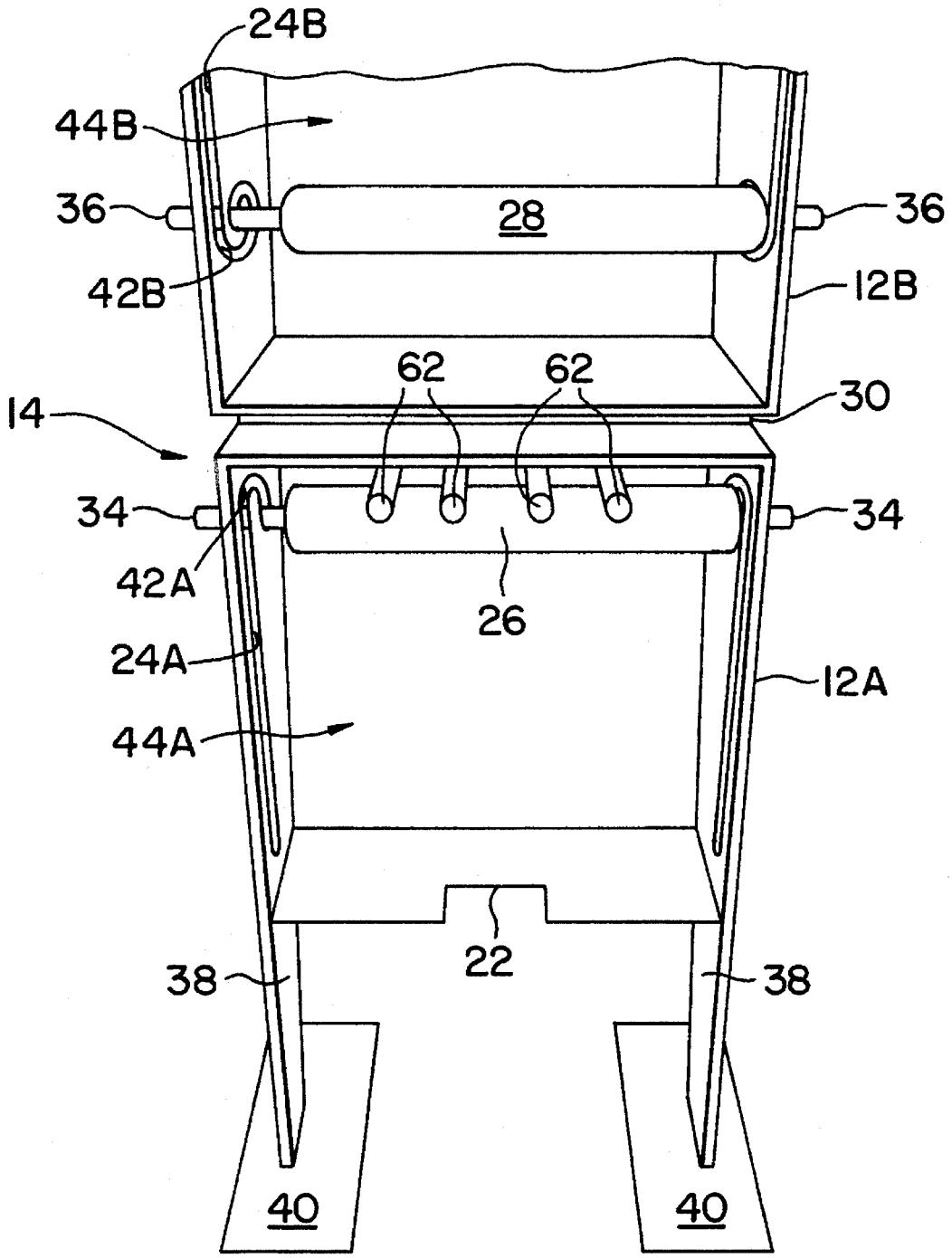
FIG. 3 is a front view of the dispenser housing opened to illustrate the arrangement of the rollers within the housing and hangers for suspending a collapsible bag therein.

The roller retaining slot extensions 42B in both sides of the movable housing portion 12B are designed so that the other roller 28 is retained at the top of the movable housing portion 12B when it is rotated into an open position, as illustrated, for example, in FIG. 3. For that reason, the roller retaining slot extensions 42B are turned outwardly and then inwardly relative to the vertical linear guide slots 24B for a total of at least about 270°. As will be apparent from the following description, this permits the other roller 28 to be moved to the top of the vertical guide slots 24B and then travel along the roller retaining slot extensions 42B so that its axles 36 rest in a lowermost portion of the slot extensions 42B with the movable housing portion 12B in a closed position as illustrated in FIG. 1. As the movable housing portion 12B is then rotated into the open position of FIG. 3, the axles 36 travel along the slot extensions 42B to its innermost portion so that they are prevented from approaching the vertical guide slots 24B when the housing is open.

The construction and function of the rollers 26 and 28 is described below with reference to FIG. 5.

Figure 2:
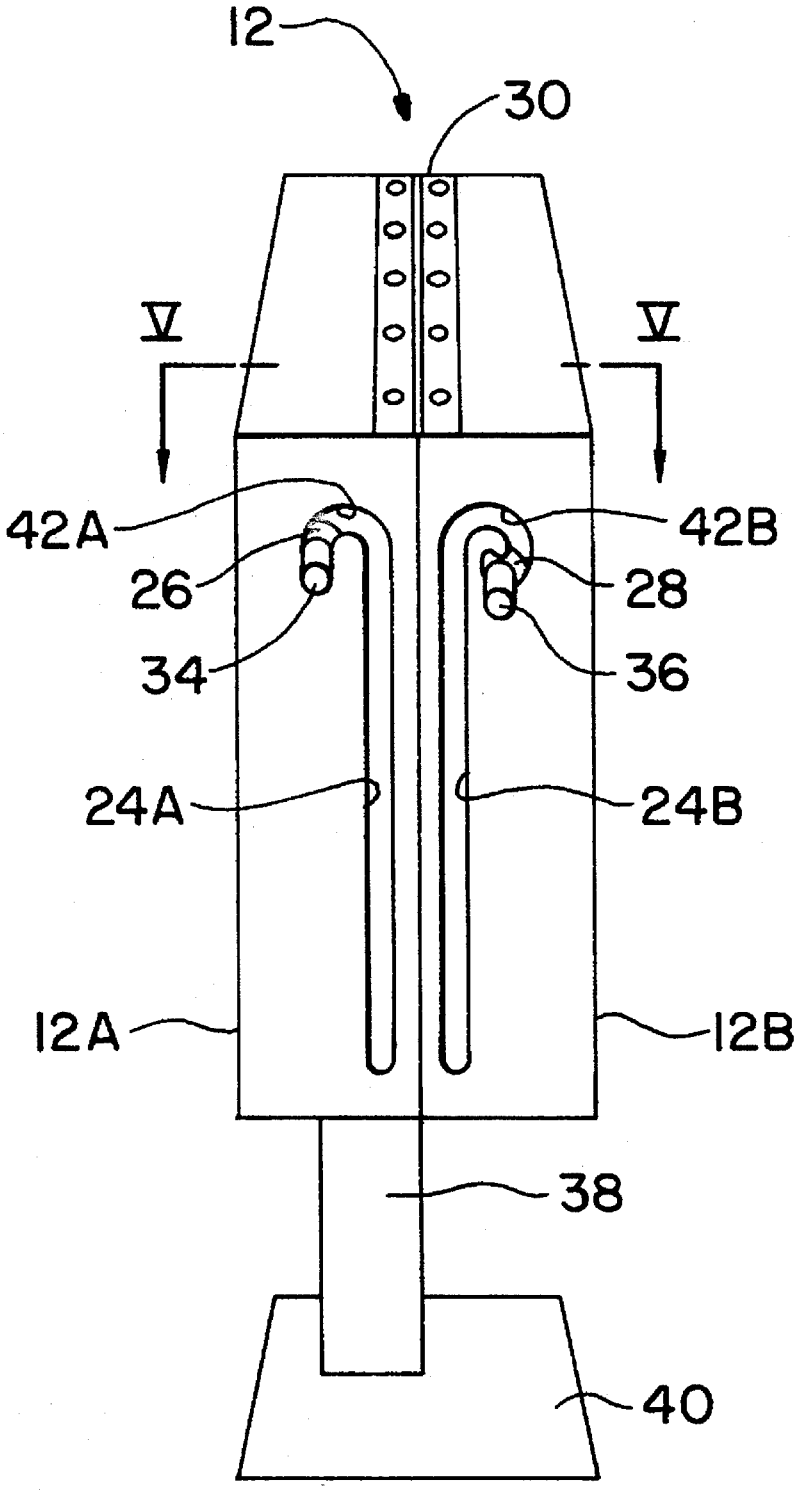
FIG. 2 is a side view in elevation of the housing illustrating guide slots for positioning rollers within the housing and also illustrating roller retaining slot extensions formed in the housing.

FIG. 2 is a side view of the housing 12 in a closed position with the axles 34 and 36 for the rollers 26 and 28 being secured in the roller retaining slot extensions 42A and 42B as described above.

Referring now to FIG. 3, the housing 12 is illustrated in an open position with the movable housing portion 12B rotated upwardly about the hinge 30 so that the movable housing portion 12B rests on top of the fixed housing portion 12A.

With the housing 12 open, it may be seen that the fixed housing portion 12A forms a partial cavity 44A below the hanger means 14 and the first roller 26 resting on its axles 34 in the roller retaining slot extensions 42A. The partial cavity 44A in the fixed housing cooperates with a similar partial cavity 44B in the movable housing portion 12B for receiving the collapsible bag 16, described in greater detail below with reference to FIG. 5.

Continuing with reference to FIG. 3, an opening 22 is formed at the bottom of the housing, preferably in the fixed housing portion 12A for allowing the outlet 18 and dispenser means 20 on the collapsible bag 16 to be accessible below the housing as illustrated in FIG. 5.

Figure 4:
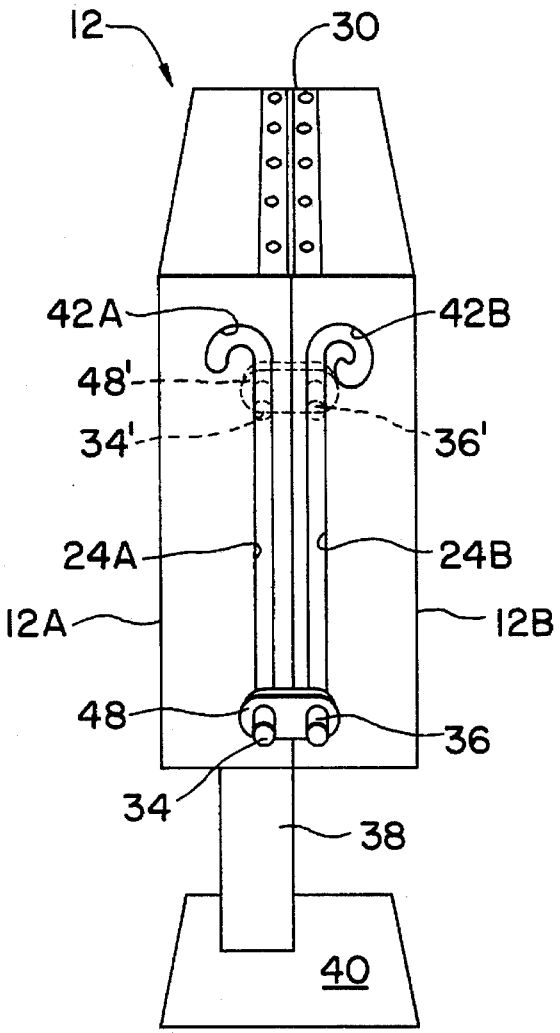
FIG. 4 is a side view of the closed housing with the rollers illustrated together with a yoke at the lower ends of the guide slots at the completion of an operating cycle, the rollers also being illustrated in phantom at an initial starting position.
Figure 4A:
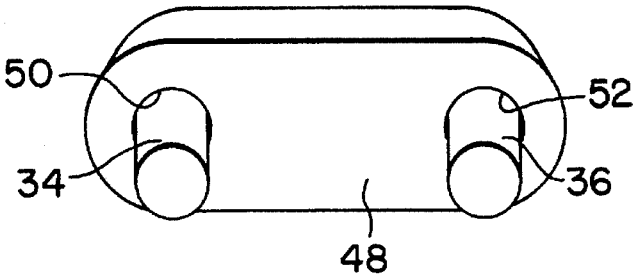
FIG. 4A is a pictorial representation of the yoke interconnected between axles of the roller.

Continuing with reference to FIG. 4, the axles 34 and 36 extending from the two rollers 26 and 28 on each side of the housing 12 are preferably interconnected or joined by means of a yoke as indicated at 48. Each yoke 48 could, for example, be a flexible continuous elastomeric band or the like (not shown). However, as may be best seen in FIG. 4A, each yoke 48 is preferably of rigid construction, for example, of stamped or molded metal, having bearing holes 50 for receiving the axles 34 and 36 while readily permitting preferably parallel rotation of the rollers on their axles. At the same time, the spacing between the bearing holes 50 and 52 precisely establishes the spacing between the rollers 26 and 28 to provide a nip or spacing 54 between the surfaces of the rollers as illustrated in FIG. 5. As discussed below with reference to FIG. 5, the nip 54 between the rollers is selected so that the rollers extrude or doctor substantially all fluid from the bag 16 during operation. By "doctor" it is meant to describe the action of extracting substantially all of the fluid from the bag by the calendaring action of the roller surfaces.

One yoke 48 and roller axles 34 and 36 are illustrated in phantom in FIG. 4 at the upper ends of the vertical guide slots 24A and 24B adjacent the roller retaining slot extensions 42A and 42B. It may be seen from FIG. 4 that the slots 24A and 24B establish the same spacing between the rollers along substantially the entire length of the housing 12 in order to assure uniform extrusion or doctoring of fluid along the entire vertical length of the collapsible bag 16. The yokes 48 provide for coincident, or paired, travel of the roller axles 34 and 36, resulting in a uniform nip 54 between rollers 26 and 28 as they travel down the slots 24A and 24B.

Figure 7:
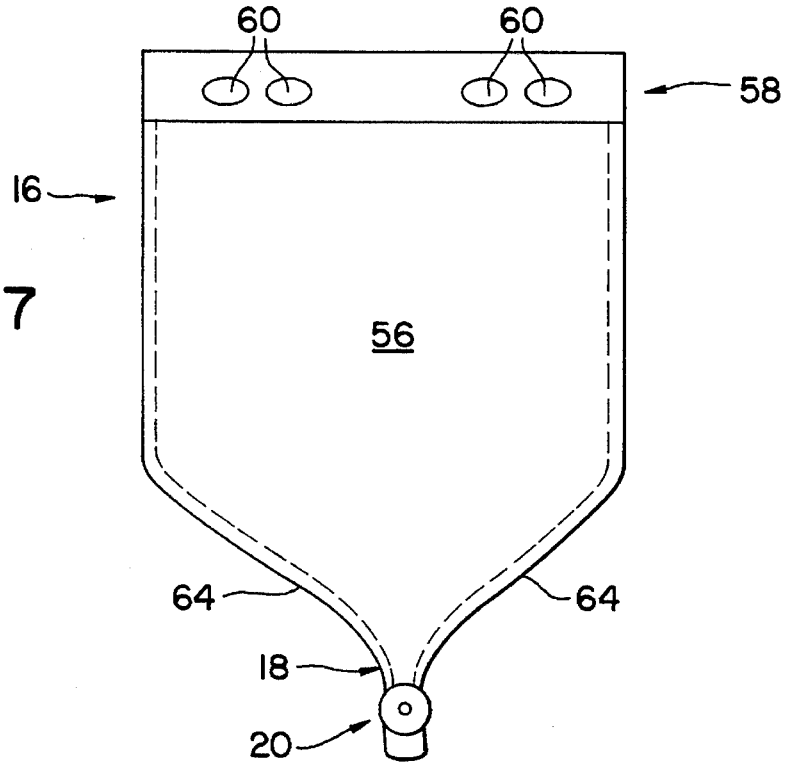
FIG. 7 is a front view of a collapsible bag adapted for use with the dispenser housing of the present invention.
Figure 8:
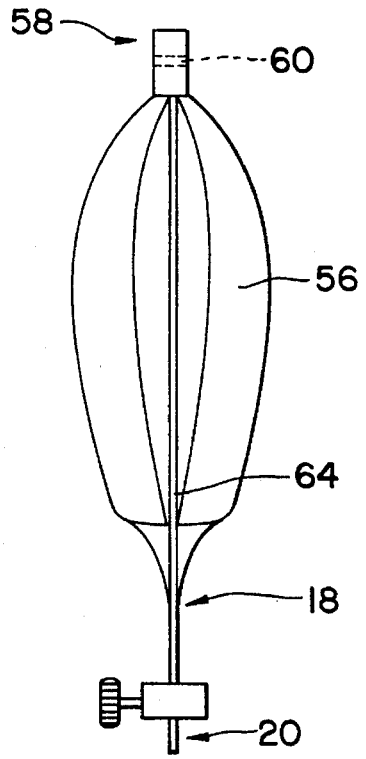
FIG. 8 is a side view of the collapsible bag of FIG. 7.

The collapsible bag 16 is best illustrated in FIGS. 7 and 8. As illustrated therein, the bag 16 forms an elongated fluid compartment 56 which is entirely enclosed except for the outlet 18 which is regulated by the dispenser means 20. The upper end 58 of the bag 16 is reinforced and forms multiple openings 60 arranged to mate with pegs 62 forming the hanger means 14 (see FIGS. 3 and 5).

A bottom portion of the bag 16 is formed with laterally tapered edges 64 extending downwardly and inwardly toward the outlet 18 in order to further assure that substantially all fluid is extruded or doctored from the fluid compartment 56 of the bag 16 and caused to pass outwardly through the outlet 18 when the dispenser means 20 is actuated.

Referring again to FIGS. 3 and 5, the bag 16 is positioned within the housing to be accommodated by the cavities 44A and 44B with the movable housing portion 12B rotated upwardly on the hinge 30 into the position illustrated in FIG. 3. The collapsible bag 16 is vertically suspended within the housing by arranging the bag 16 so that the openings 60 in the upper reinforced end 58 of the bag receive the pegs 62 forming the hanger means 14. As is illustrated in FIG. 5, the pegs 62 are located in the center of the enclosure and uniformly extend outwardly from a bar 66 secured from the upper end of the fixed housing portion 12A just above the vertical guide slots 24A and 24B as well as the roller retaining slot extensions 42A and 42B.

The bag 16 is further arranged within the housing so that its outlet 18 extends through the opening 22 at the bottom of the housing with the dispenser means 20 being exposed for use. With the movable housing portion 12B then rotated into its closed position, only the dispenser means 20 is exposed at the bottom of the housing 12. The dispenser means 20 may be any of a variety of manually operated devices such as the push-button control illustrated in the figures.

Once the bag 16 is arranged within the housing and the housing closed as described above, the rollers 26 and 28 are then moved from the roller retaining slot extensions 42A and 42B into the vertical guide slots 24A and 24B. At the same time, the yokes 48 are mounted upon the axles 34 and 36 extending from the rollers on each side of the housing.

With the bag 16 being substantially filled with fluid, the yoked rollers 26 and 28 engage the bag just below its reinforced upper end 58. As noted above, the yoked rollers 26 and 28 form the nip 54 which is selectively sized to generally conform to the thickness of the bag without any fluid.

In this manner, downward travel of the rollers under the influence of gravity is limited by the filled bag 16.

The rollers 26 and 28 are formed from a relatively heavy material such as metal and preferably each have a mass sufficient for collapsing the bag under the influence of gravity (on the rollers) in order to positively extrude or doctor downwards substantially all fluid from the bag in response to operation of the dispenser means 20.

With the dispenser assembly 10 being adapted for dispensing salad dressing or the like, the bag may typically have a capacity of about two gallons. The weight of the rollers is sufficient to assure proper operation of the dispenser assembly as described.

It is important to understand that the roller retaining slot extensions 42A and 42B are positioned so that the rollers 26 and 28, upon removal from the roller retaining slot extensions engage the bag just below the reinforced upper end 58 as described above in order to assure that they extrude or doctor substantially all fluid from the bag.

The rollers act under the influence of gravity to exert a constant downward force against the bag 16 so that fluid is delivered from the bag at a substantially constant delivery rate in response to opening of the dispenser device 20.

Also because of the constant force applied by the rollers to the bag, fluid within the bag is uniformly purged through the outlet 18 and toward the dispenser device 20. It is also noted again that the bag 16 is entirely closed or sealed except for the outlet 18 and dispenser device 20, as described above. Accordingly, fluid within the bag 16 remains unexposed to the atmosphere until it exits from the bag outlet by means of the dispenser device 20. This is important in connection with fluids which may suffer for example from oxidation or the like.

The method of operation for the dispenser assembly 10 is believed apparent from the preceding description. However, the method of operation is described briefly below in order to assure complete disclosure of the invention.

Initially, the length of each of the rollers 26 and 28 is preferably slightly less than the inside spacing between the sides of the housing portions 12A and 12B so that the rollers can be tilted to engage their axles 34 and 36 in the vertical guide slots 24A and 24B. With the rollers positioned within the housing and the housing 12 configured as described above, the rollers are preferably moved into the roller retaining slot extensions 42A and 42B with the housing in a closed position as illustrated for example in FIG. 4. Since the axles 34 and 36 are free to rotate within the retaining slot extensions, they tend to move to the lowermost portions in the slot extensions.

The housing is then opened by rotating the movable housing portion 12B about the hinge 30 into the position illustrated in FIG. 3. As the movable housing portion 12B is rotated in this manner, the axles 34 and 36 on the second roller 28 move downwardly and then inwardly along the retaining slot extensions 42B so that the roller 28 remains positioned and suspended with the movable housing portion 12B in its raised position.

With the housing being open, the pegs 62 of the hanger means 14 are exposed to permit and facilitate suspending of the bag 16 as described above with the opening 60 in the reinforced upper end 58 of the bag receiving the pegs 62 and the outlet 18 of the bag extending through the opening 22 of the housing to expose the dispenser device 20 beneath the housing.

The housing is then closed. The rollers 26 and 28 are moved along the slot extensions 42A and 42B toward the top of the vertical guide slots 24A and 24B where they are secured together by means of the yokes 48 to establish the nip 54 with the bag 16 arranged therebetween.

With the rollers in this configuration, they are applying substantial force under the influence of gravity against the bag.

The dispenser assembly 10 is then in condition for use with the rollers 26 and 28 operating under the influence of gravity in response to actuation of the dispenser device 20. When the dispenser device 20 is opened, the rollers apply uniform force to the bag so that fluid exits the bag outlet through the dispenser device 20 at a substantially constant delivery rate as long as the dispenser device 20 remains open. Thus, the dispenser assembly 10 is particularly adapted for intermittent use with constant fluid flow being assured at any time when the dispenser device 20 is opened.

The interconnection of the rollers by the yokes 48 form the nip 54 assures that the rollers extrude or doctor substantially all fluid from the bag toward the outlet 18 as the rollers travel downwardly through the housing under the influence of gravity. It is noted that the collapsed portion of the bag 16 is exaggerated, the clearance or nip 54 actually being defined by the amount of space taken up by the collapsed portion of the bag itself.

Operation in this manner continues until the rollers 26 and 28 approach the lower ends of the vertical guide slots 24A and 24B, that is, the position illustrated in FIG. 4. At that point, the rollers are closely adjacent the outlet 18 with the tapered sides 64 of the bag further assuring that substantially all fluid is extracted or doctored from the bag.

At that point, the rollers can then be raised and retained in the slot extensions 42A and 42B. The empty bag 16 can be removed from the housing and a fresh bag filled with fluid installed in the same manner to facilitate continued operation of the dispenser assembly.

Accordingly, there has been described above a preferred embodiment of a dispenser assembly including a housing and collapsible bag adapted for a method of use as also described above. Variations and/or modifications of the apparatus and method are believed obvious in addition to those specifically described above. For example, it is noted that the housing 12 need not form an enclosure as described above. It could, for example, be a generally open structure while accomplishing its function. Other variations are of course possible both within the housing and elements mounted upon the housing as well as in the collapsible bag 16. Accordingly, the scope of the present invention is defined only by the following appended claims which are further exemplary of the invention.

What is claimed is:

1. A dispenser for viscous fluids, comprising a housing having an opening in a lower portion thereof, a collapsible bag having an outlet, dispenser means arranged in the bag outlet for dispensing fluid from the bag, hanger means in the form of multiple pegs arranged in an upper portion of the housing for suspending the bag generally vertically with the bag outlet extending through the housing opening, roller means forming a nip and having a mass sufficient for collapsing the bag under the influence of gravity in order to positively extrude the fluid from the bag in response to operation of the dispenser means, and guide means allowing the roller means to descend under the influence of gravity from an initial position adjacent the hanger means only when the fluid is expelled from the bag, the collapsible bag forming an elongated flexible closure and having reinforced openings at its upper end for mating with the multiple pegs, the outlet being in a lower end of the bag, and dispenser means arranged in the bag outlet for dispensing fluid extruded from the bag by the roller means and otherwise forming an enclosed compartment for the fluid whereby fluid in the collapsible bag remains unexposed to the atmosphere until it exits from the bag outlet, the collapsible bag being laterally tapered adjacent the outlet at its lower end and having a thickness corresponding to the nip formed by the roller means to facilitate extrusion of substantially all fluid from the bag by the roller means.

2. The dispenser of claim 1 wherein the housing further comprises a movable portion for at least one of installing or replacing the collapsible bag.

3. The dispenser of claim 1 wherein the housing includes support means so that the housing is free-standing.

4. The dispenser of claim 1 wherein said housing comprises a first portion which is fixed and a second portion which is movable for at least one of installing or replacing the bag, the fixed housing portion having a roller retaining slot extension turned approximately 180° relative to its linear slot, the movable housing portion having a roller retaining slot extension turned at least 270° relative to its linear slot.

5. The dispenser of claim 4 wherein the multiple pegs are located on the housing adjacent the upper ends of the slots, the bag having reinforced openings mating with the pegs.

6. The dispenser of claim 5 wherein the tapered bag adjacent the outlet facilitates doctoring of all fluids therefrom by the rollers.

7. The dispenser of claim 5 wherein the housing includes support means on its fixed portion so that the housing is free-standing.

8. A dispenser for viscous fluids, the dispenser adapted for use with a collapsible bag having an outlet and dispenser means arranged in the bag outlet for dispensing fluid therefrom, comprising a housing having an opening in a lower portion thereof, hanger means arranged in an upper portion of the housing for suspending the bag generally vertically with the bag outlet extending through the housing opening, a pair of rollers each having a mass sufficient for collapsing the bag under the influence of gravity in order to positively expel the fluid from the bag in response to operation of the dispenser means, and guide means for maintaining the rollers in opposed relation with the collapsible bag therebetween and the rollers initially adjacent the hanger means, the guide means allowing movement of the opposed rollers toward the housing opening whereby the rollers extrude substantially all fluid in the bag toward the bag outlet at a substantially constant delivery rate in response to operation of the dispenser means, the guide means comprising two parallel pairs of linear slots formed vertically by opposite sides of the housing, the rollers having axles extending through the slots, the housing having a movable portion for at least one of installing or replacing the bag, the housing forming roller retaining slot extensions turned relative to the two parallel paris of linear slots respectively for supporting the rollers during at least one of installation or replacement of the bag.

* * * * *